US008834148B2

(12) United States Patent
Hufschmidt et al.

(10) Patent No.: US 8,834,148 B2
(45) Date of Patent: Sep. 16, 2014

(54) APPARATUS FOR THE PRODUCTION OF A TURF YARN

(75) Inventors: Klaus Hufschmidt, Remscheid (DE); Jens Weinhold, Chemnitz (DE); Frank Heymann, Chemnitz (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 401 days.

(21) Appl. No.: 13/203,963

(22) PCT Filed: Mar. 1, 2010

(86) PCT No.: PCT/EP2010/052558

§ 371 (c)(1),
(2), (4) Date: Aug. 30, 2011

(87) PCT Pub. No.: WO2010/102921

PCT Pub. Date: Sep. 16, 2010

(65) Prior Publication Data

US 2011/0309542 A1 Dec. 22, 2011

(30) Foreign Application Priority Data

Mar. 12, 2009 (DE) ..... 10 2009 012 936

(51) Int. Cl.

| | |
|---|---|
| ***B29C 47/00*** | (2006.01) |
| ***D02J 1/22*** | (2006.01) |
| ***D01D 13/02*** | (2006.01) |
| ***D02G 3/28*** | (2006.01) |
| ***D02G 3/44*** | (2006.01) |
| ***D02G 1/16*** | (2006.01) |

(52) U.S. Cl.

CPC ..... *D02G 3/445* (2013.01); *D01D 13/02* (2013.01); *D02G 3/285* (2013.01); *D10B 2505/202* (2013.01); *D02G 1/161* (2013.01)

USPC ..... 425/505; 425/376.1; 425/319; 264/103; 264/210.1

(58) Field of Classification Search

None

See application file for complete search history.

(56) References Cited

U.S. PATENT DOCUMENTS

| | | | |
|---|---|---|---|
| 2,145,346 | A | 1/1939 | Dreyfus |
| 3,837,980 | A | 9/1974 | Nishimura et al. |
| 3,940,522 | A | 2/1976 | Wessells |

(Continued)

FOREIGN PATENT DOCUMENTS

| | | |
|---|---|---|
| EP | 0 996 781 | 10/2002 |
| JP | 2000-178824 | 6/2000 |

OTHER PUBLICATIONS

International Search Report for International Application No. PCT/EP2010/052558.

*Primary Examiner* — Benjamin Schiffman

(74) *Attorney, Agent, or Firm* — Alston & Bird LLP

(57) ABSTRACT

The invention relates to a method and an apparatus for producing a turf yarn for artificial turf. According to the invention, several monofilaments or ribbons are produced from one respective polymer material in two parallel extrusion processes, the turf yarn being formed by combining several monofilaments or ribbons obtained in the first extrusion process with several monofilaments or ribbons obtained in the second extrusion process. In order to improve especially the elasticity of an artificial turf carpet made from said turf yarn, the monofilaments or ribbons obtained in one of the extrusion processes are crimped before being combined, the crimped monofilaments or ribbons and the flat monofilaments or ribbons being produced in parallel next to each other and being joined in a winding station by means of a tie thread.

7 Claims, 4 Drawing Sheets

(56) References Cited

U.S. PATENT DOCUMENTS 4,061,804 A * 12/1977 McCulloch ..... 428/17
6,085,395 A * 7/2000 Weiss ..... 28/221
2008/0187689 A1 8/2008 Dierkens et al.
2010/0255223 A1 * 10/2010 De Vries ..... 428/17

* cited by examiner

APPARATUS FOR THE PRODUCTION OF A TURF YARN

BACKGROUND OF THE INVENTION

1. Field of the Invention

The invention relates to a method for the production of a turf yarn for artificial turf, and to an apparatus for carrying out the method.

2. Description of Related Art

So-called turf yarns are used in the production of artificial turf, and have a composite of multiple monofilaments or multiple ribbons. As such, the turf yarn is processed into an artificial turf by means of a tufting process. The artificial grass blades are formed by the monofilaments and/or the ribbons inside the artificial turf. Producers strive to make the artificial fibers imitate the characteristics of natural grass blades as much as possible. As such, the prior art includes means of influencing the cross-section, coloring, and the structure of the monofilaments or ribbons according to the characteristics of natural grass blades. In order to improve the characteristics of artificial turf, particularly with respect to elasticity and the ability of the individual fibers to return to an upright position, it has been found that this is particularly possible by implementing grass yarns which are produced by creating a composite of multiple monofilaments made of different polymer materials.

As such, a grass yarn is known from EP 0 996 781 B 1, formed from monofilaments or ribbons made of different polymer materials, and produced in two extrusion processes which are operated in parallel. In the known method, however, only the differing characteristics of the polymer materials are used to obtain certain improvements in the artificial turf In this case, particularly the visual characteristics and resistance to abrasion are influenced.

SUMMARY OF VARIOUS EMBODIMENTS

In contrast, the present invention addresses the problem of creating a method for the production of a turf yarn of the generic type, as well as an apparatus for carrying out the method, by means of which a turf yarn can be made which provides high long-term flexibility in an artificial turf.

This problem is addressed by a method and an apparatus for the production of a turf yarn for artificial turf.

Advantageous implementations of the invention are defined by the features and combinations of features given in the various embodiments described herein.

The invention is based on the realization that the characteristics of the turf yarn in the artificial turf can also be influenced particularly by structural differences in the fiber composite. As such, the monofilaments or ribbons from one of the extrusion processes are crimped prior to being brought together with the other monofilaments. The crimped monofilaments or ribbons or the flat monofilaments or ribbons are produced in parallel next to each other, and are brought together in a winding station with a tie thread. In this way, it is possible to produce the two monofilaments or ribbons, the same being generated on two separate extrusion machines, in parallel next to each other, and then bring the two together at the end to make the turf yarn. Each turf yarn consequently contains crimped monofilaments or ribbons and flat monofilaments or ribbons, each being made of different polymer materials. By means of the winding of the monofilaments, sufficient cohesion thereof for a subsequent tufting process is ensured on the one hand, while on the other hand, dispersion of the composite in the artificial turf is made easier.

As such, it has been determined that, following the tufting process with no tension on the fibers, the crimped monofilaments pull back due to their crimping, to consequently form a base tuft in the artificial turf. This leads to a high long-term flexibility of the artificial turf. The flat monofilaments, in contrast, form the turf fibers, and protrude with their softness.

In addition, the ability of the flat monofilaments to return to the upright position is facilitated by the crimped monofilaments in the base tuft. As such, corresponding artificial turf has a longer usable life.

The method according to the invention and the apparatus according to the invention are particularly advantageous for producing such a turf yarn in a single process.

For the purpose of continuously guiding the crimped monofilaments and the flat monofilaments together independently of the crimping process, the method variant is preferably used wherein the crimped monofilaments or ribbons are produced with a higher production speed in the extrusion process prior to the crimping than the flat monofilaments or ribbons. The crimped monofilaments or ribbons are crimped in this case by means of texturing in a compression chamber, such that the difference in speed between the extrusion processes can be exploited to obtain an intensive crimping of the crimped monofilaments.

In this case, it is possible to select the difference in speed between the two production speeds of each extrusion process according to the compression chamber texturing. The speed is selected in such a manner that following the texturing in a compression chamber, the crimped monofilaments or ribbons and the flat monofilaments or ribbons are drawn off at the same speed of production, and can then be supplied to a winding station.

In the event that the turf yarn is formed in a composite with crimped ribbons, the method variant is particularly advantageous wherein the ribbons are fibrillated in an additional treatment step prior to the crimping. The fibrillation produces a network-like structure on the ribbons which leads to special effects in the further processing thereof. As such, it has been demonstrated that such network-like structures break up in a tufting process for the purpose of producing a turf carpet, such that the blades of grass can appear as monofilaments.

The turf yarn produced by bringing together the crimped and flat monofilaments or ribbons is rolled into a spool following the winding. As such, the turf yarn can immediately be fed to a subsequent tufting process. At this point, it is hereby expressly stated that the turf yarn is not only formed by bringing together monofilaments or by bringing together ribbons, but rather can also be created, in an advantageous manner, by bringing together monofilaments and ribbons. As such, extrusion processes for monofilaments and ribbons can be combined with no problem for the purpose of producing turf yarns.

The yarn characteristics required for a turf yarn, such as abrasion resistance, flexibility, and the ability to return to an upright position, for example, are particularly improved further in that the crimped monofilaments or ribbons are improved from the polymer material polyamide, and the flat monofilaments or ribbons are improved from the polymer material polyethylene, particularly a linear low-density polyethylene (LLDPE). Of course, other combinations of materials are also possible, wherein the crimped monofilaments or ribbons are not extruded from a polyamide, but rather from another polymer.

The flat monofilaments or ribbons which actually form blades of grass in the artificial turf can be produced in an advantageous manner according to the method variant wherein the flat monofilaments or ribbons are produced by coextrusion from two polymer materials based on polyethylene and having different colors. As such, it is possible, for example, to design the visual form of appearance by means of two differently colored sides on the monofilament or the ribbon, in such a manner that a blade of grass is formed which has a dark-green side and a light-green side, for example.

In addition to monofilaments having two differently colored sides, a mixture of differently colored monofilaments can also be used. In this case, some of the monofilaments or ribbons in the composite are, for example, dark green, while the remaining monofilaments or ribbons in the composite are light green, for example.

In addition, the possibility exists of producing the monofilaments from two different raw materials, to produce a core-sheath construction. In addition a profile of the monofilaments in all previously named variants improves the ability of the same to return to an upright position.

So that the turf yarn can be produced in a large amount, the method variant is preferably used wherein the crimped monofilaments or ribbons are distributed in a plurality of fiber bundles each having a certain number of crimped monofilaments or ribbons, wherein the flat monofilaments or ribbons are distributed in a plurality of fiber bundles each having a certain number of flat monofilaments or ribbons, and wherein in each case a fiber bundle with crimped monofilaments or ribbons and a fiber bundle with flat monofilaments or ribbons are fed together for winding and rolling into a spool. As such, multiple turf yarns can be produced in parallel.

The distribution of the crimped monofilaments or ribbons into a plurality of fiber bundles can in this case be carried out according to the crimping process, as well as prior to the crimping or following the crimping. In principle, the possibility also exists of crimping the plurality of fiber bundles individually by means of crimping devices which texture the fiber bundles independently of each other. However, the possibility also exists to crimp the grouping of monofilaments or ribbons together by means of a crimping device.

The apparatus according to the invention for carrying out the method according to the invention has two extrusion devices arranged next to each other for the purpose of producing monofilaments or ribbons. A tie device for bringing multiple monofilaments or ribbons together into a turf yarn is arranged immediately after the extrusion devices. In order to crimp the monofilaments or ribbons of one of the extrusion devices, a crimping device is arranged downstream of one of the extrusion devices. As such, a turf yarn can be advantageously produced from a composite of flat and crimped monofilaments or ribbons in one method step.

For the purpose of setting the speed of production in the extrusion devices, a godet assembly is provided in each of the extrusion devices, wherein the godet rolls of each extrusion device are driven independently of each other and can be controlled independently of each other. As such, differences in production speed between the extrusion devices can be chosen so that subsequent, different treatments of the monofilament or ribbons can be carried out.

For the purpose of crimping the monofilaments or ribbons, texturing in a compression chamber is preferably employed, wherein the monofilaments or ribbons are conveyed into a compression chamber. Depending on the design of the crimping device, in this case the monofilaments or ribbons can be guided together into a compression chamber via a roll gap of two crimping rolls. Or, as an alternative, each of the monofilaments or ribbons can be guided through a conveyor nozzle into a compression chamber as individual fiber bundles. Heated, pressurized air is preferably used as the means of conveyance in this case, the same being conveyed into the compression chamber together with the monofilaments or ribbons by means of the conveyor nozzles, and intruded to make a plug. However, in principle, other crimping methods are also possible for the purpose of producing a crimped structure on the monofilaments or ribbons. For example, in certain cases, texturing with air could also be used, wherein the crimping is produced by means of swirling the monofilaments or ribbons by means of pressurized air.

The composite of the individual monofilaments is preferably secured by a tie thread, such that the tie device has a winding station. A spooling device is arranged directly behind the tie device for the purpose of spooling the turf yarn.

In the event that a group of monofilaments or ribbons must be foamed from multiple polymer materials, in one advantageous implementation of the apparatus according to the invention, one of the extrusion devices or both of the same have one or two extruders for the purpose of melting polymaterials. As such, both monofilaments and films can be produced by coextrusion.

For the purpose of producing many turf yarns in parallel next to each other, a tie device and a spooling device having multiple winding stations and spooling stations are preferably functionally assigned to the extrusion devices. In this way, a plurality of spools with turf yarn can be produced in parallel.

BRIEF DESCRIPTION OF THE SEVERAL VIEWS OF THE DRAWINGS

The method according to the invention and the apparatus according to the invention are described in greater detail below with reference to several embodiments of the apparatus according to the invention, wherein.

DETAILED DESCRIPTION

Figure 1:
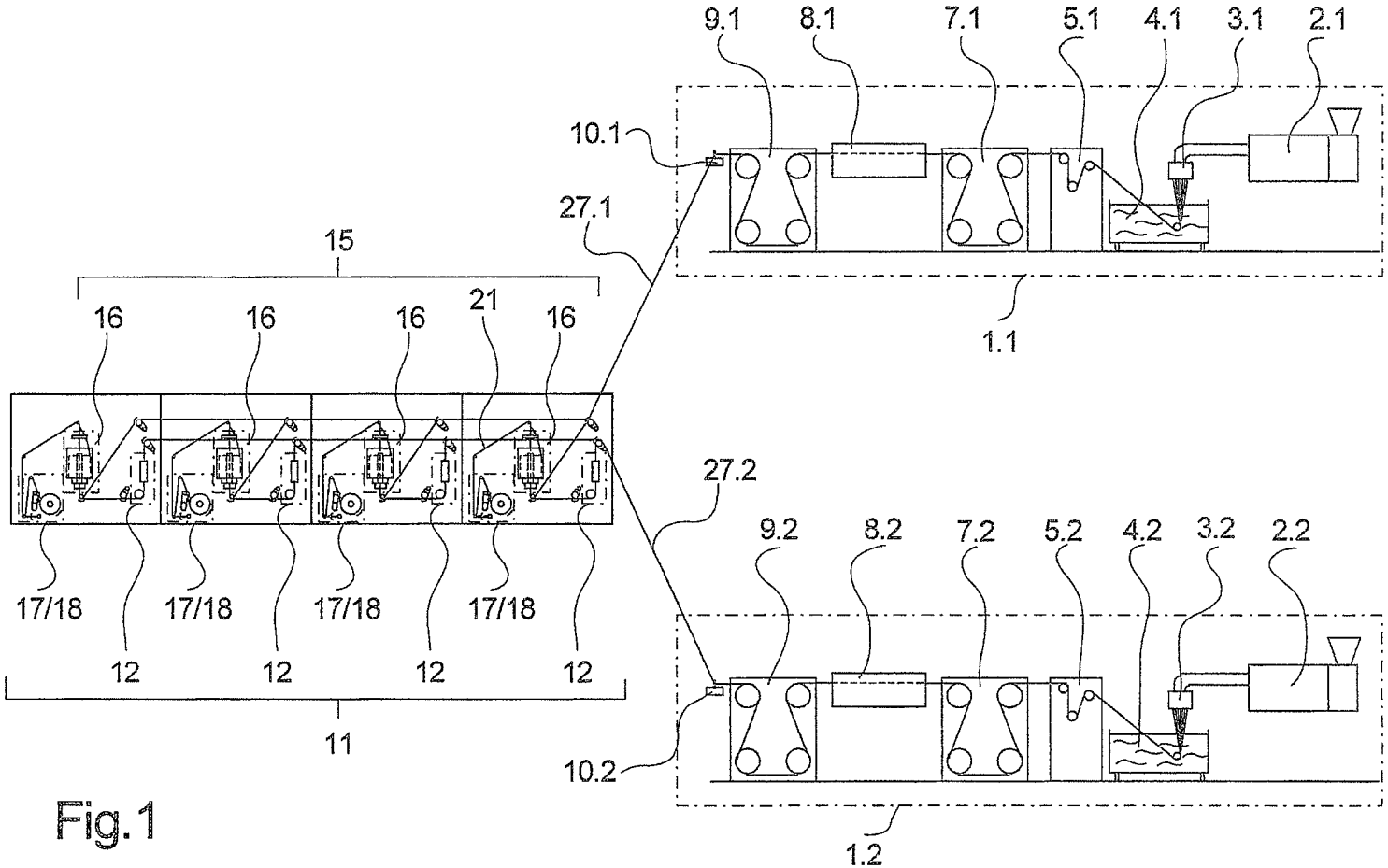
FIG. 1 shows a schematic view of a first embodiment of the apparatus according to the invention for carrying out the method according to the invention.
Figure 2:
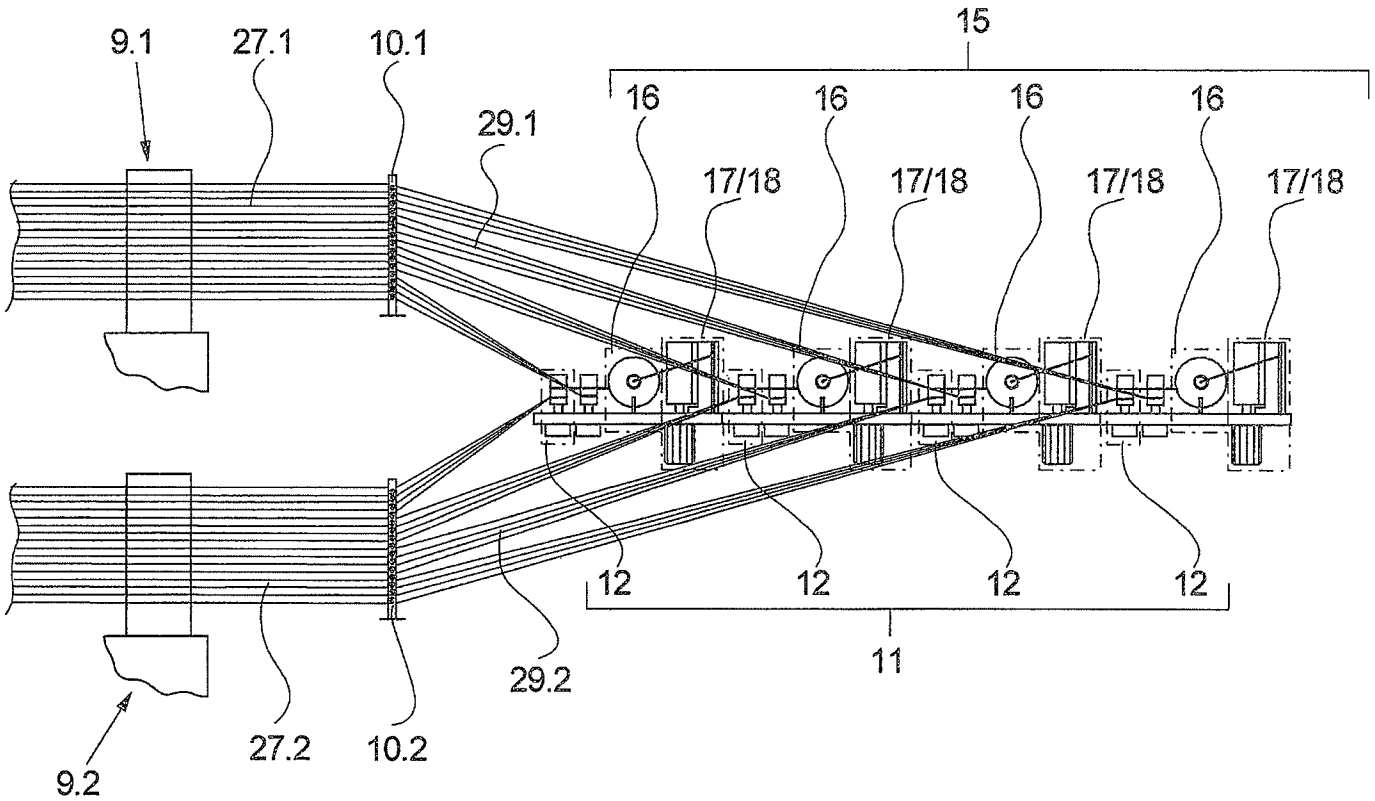
FIG. 2 shows a schematic top view of the winding stations and spooling stations of the embodiment in FIG. 1.
Figure 3:
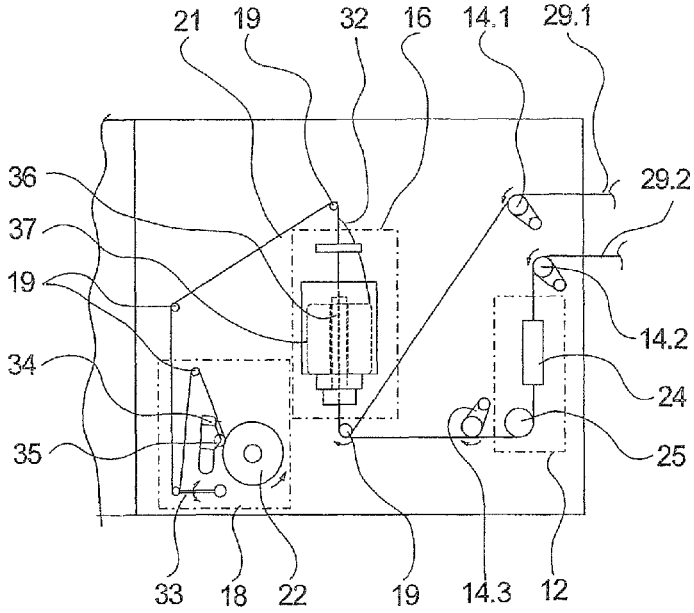
FIG. 3 shows a schematic side view of a winding and spooling station of the embodiment in FIG. 1.

In FIG. 1 to FIG. 3, a first embodiment of the apparatus according to the invention for carrying out the method according to the invention is illustrated schematically. In FIG. 1, the embodiment is shown in a full schematic view, in FIG. 2 it is shown in a top schematic view of the winding stations and spooling stations, and in FIG. 3 it is shown in a partial schematic view of the winding stations and spooling stations. The following description applies to all these figures unless an explicit reference is made to one of the figures.

In FIG. 1, the embodiment of the apparatus according to the invention is illustrated in a full view. The embodiment has two extrusion devices 1.1 and 1.2 which are arranged next to each other, for the purpose of producing a plurality of monofilaments from one thermoplastic polymer material. In this embodiment, the extrusion devices 1.1 and 1.2 are equipped with the same, exemplary apparatus parts, such that the construction of the extrusion devices 1.1 and 1.2 is explained below using the example of the extrusion device 1.1.

The extrusion device 1.1 has an extruder 2.1 and an extruder head 3.1 connected to the extruder 2.1. A cooling bath 4.1 is functionally assigned to the extrusion head 3.1. Multiple godet assemblies 7.1 and 9.1 having driven godets are arranged one behind the other for the purpose of drawing off and stretching the extruded monofilaments. In this case, the monofilaments are guided with a simple wrap on the periphery of the driven godets of the godet assemblies 7.1 and 9.1 in parallel routing next to each other.

A deflection assembly 5.1 having multiple deflection rolls is provided between the cooling bath 4.1 and the first godet assembly 7.1, and the monofilaments are guided on the periphery of said deflection rolls with a simple wrap. The deflection assembly 5.1 is arranged immediately behind the cooling bath 4.1 in order to strip off the cooling bath 4.1 cooling fluid adhering to the monofilaments. It is typically possible to further improve the drying of the monofilaments by means of additional suction devices designed as suction slits on stationary deflection cylinders. As such, the deflection rolls can also be replaced in the deflection assembly 5.1 by deflection cylinders having integrated suction.

A heating device 8.1 is arranged between the godet assemblies 7.1 and 9.1. The heating device 8.1 could be formed by a circulating air oven, for example, in which the monofilaments are heated to a stretching temperature. For the purpose of stretching the monofilaments, the godets of the godets rolls 7.1 and 9.1 are driven with a difference in speed between the two.

This construction of the extrusion devices 1.1 and 1.2 illustrated in FIG. 1, for producing two monofilament groupings 27.1 and 27.2, is exemplary in nature. In principle, a thermosetting zone having a further godet assembly can be arranged behind each of the extrusion devices, or only behind one of the extrusion devices.

However, regardless of the design of the extrusion devices, the godet assemblies 7.1, 7.2, and 9.1, 9.2, with the godets thereof, said assemblies being functionally assigned to the extrusion devices 1.1 and 1.2, can be driven and controlled independently of each other. As such, it is possible to produce the monofilament grouping 27.1 in the extrusion device 1.1 at a different production speed than that used to produce the monofilament grouping 27.2 of the second extrusion device 1.2. In this case, the further treatment of the monofilaments provided by the invention is of substantial importance.

As indicated by FIG. 1 and FIG. 2, a crimping device 11 is arranged behind the extrusion device 1.2, for the purpose of further treating the monofilaments. The crimping device 11 is formed in this example by a plurality of texturing stations 12, wherein one fiber bundle of monofilaments is crimped in each of the texturing stations 12. As such, it is possible to recognize from the top view given in FIG. 2 that the monofilament grouping 27.2 is divided into a plurality of fiber bundles 29.2 by means of the guide rail 10.2 on the outlet side of the extrusion device 1.2. Each of the fiber bundles contains a certain number of monofilaments. For example, three, four, five, or six monofilaments of the monofilament grouping 27.1 can be brought together to form a fiber bundle 29.1. The fiber bundle 29.1 is crimped in one of the following texturing stations 12, and then fed to a tie device 15.

The monofilament grouping 27.1 produced in the extrusion device 1.1 is likewise divided into a plurality of fiber bundles 29.1. The fiber bundles 29.1 are fed directly to the tie device 15, such that one fiber bundle 29.1 with flat monofilaments and one fiber bundle 29.2 with crimped monofilaments become routed in a common path.

The tie device 15 is formed by a plurality of winding stations 16 in which two fiber bundles 29.1 and 29.2, the same being guided together, are tied with one tie thread. The desired turf yarn is consequently created. The turf yarn 21 consequently contains flat monofilaments and crimped monofilaments. As such, the turf yarn 21, by way of example, can be formed from four individual flat monofilaments 19 and four individual crimped monofilaments. The flat monofilaments and the crimped monofilaments are guided into the fiber bundles 29.1 and 29.2, and are brought together into a complete bundle prior to the winding.

The routing of the thread is particularly visible in the illustration given in FIG. 3. As such, the fiber bundle 29.2 is guided through the godet unit 14.2 and 14.3 for the purpose of crimping. The texturing station 12 is shown between the godet units, and is shown in an exemplary manner by a texturing unit 24 and an out-feed roll 25. The texturing unit 24 could be formed by a texturing nozzle and a compression chamber arranged behind said texturing nozzle.

The fiber bundle 29.1 with the flat monofilaments is immediately fed to the winding station 16 via a third godet unit 14.1. The fiber bundles 29.1 and 29.2 are brought together prior to the winding station 16 and are fed to the winding stations 16 via a deflection roll 19. Inside the winding station 16, the fiber bundles 29.1 and 29.2 are wound with a tie thread 32. For this purpose, the winding station 16 has a driven hollow spindle 36, and a composite spool 37 is held on the periphery of the hollow spindle 36 with the tie thread 32.

As indicated by FIGS. 1, 2, and 3, the spooling device 17 for the purpose of spooling the turf yarns 21 is formed by a plurality of spooling stations 18. The turf yarn 21 is wound into a spool 22 in each of the spooling stations 18, and said spool 22 is held on a driven spool holder 20. For the purpose of guiding the thread, the spooling station 18 has a dancer arm regulator 33, a traverse 34, and a pressure roll 35.

In the embodiment illustrated in FIG. 1 to FIG. 3, a turf yarn 21 is produced which is processed into an artificial turf in a further processing step. The turf yarn fanned from flat monofilaments and crimped monofilaments can be formed from different polymer materials and combinations of polymer materials in this case. As such, it is possible to process different thermoplastic materials, such as PP, LLDPE, HDPE, or PA, for example, in the extrusion processes of the extrusion devices 1.1 and 1.2. However, the combination wherein flat monofilaments made of a polyethylene are produced in the extrusion process of the extrusion device 1.1 is particularly advantageous. In contrast, in the extrusion process of the extrusion device 1.2 operated in parallel, a granulate of polyamide or a similar type of polymer is melted and extruded to produce the crimped monofilaments.

In order to maintain the absence of a difference in speed between the fiber bundles 29.1 and 29.2, particularly during the winding and spooling of the turf yarn 21, the extrusion process of the extrusion device 1.2 is operated at a higher production speed than the extrusion process of the extrusion device 1.1. Consequently, particularly the last godet assembles 9.1 and 9.2 of the extrusion devices 1.1 and 1.2 are operated with a difference in speed. As such, the godet assembly 9.2 is driven with a higher peripheral speed of the godet than that of the godet assembly 9.1, such that the monofilament grouping 27.2 of the extrusion device 1.2 is guided with a higher production speed. The difference between the production speeds of the extrusion devices 1.1 and 1.2 is advantageously set in such a manner that following crimping of the fiber bundle 29.2, the subsequent treatment steps can be carried out with the same feeding speed for both fiber bundles 29.1 and 29.2.

Figure 4:
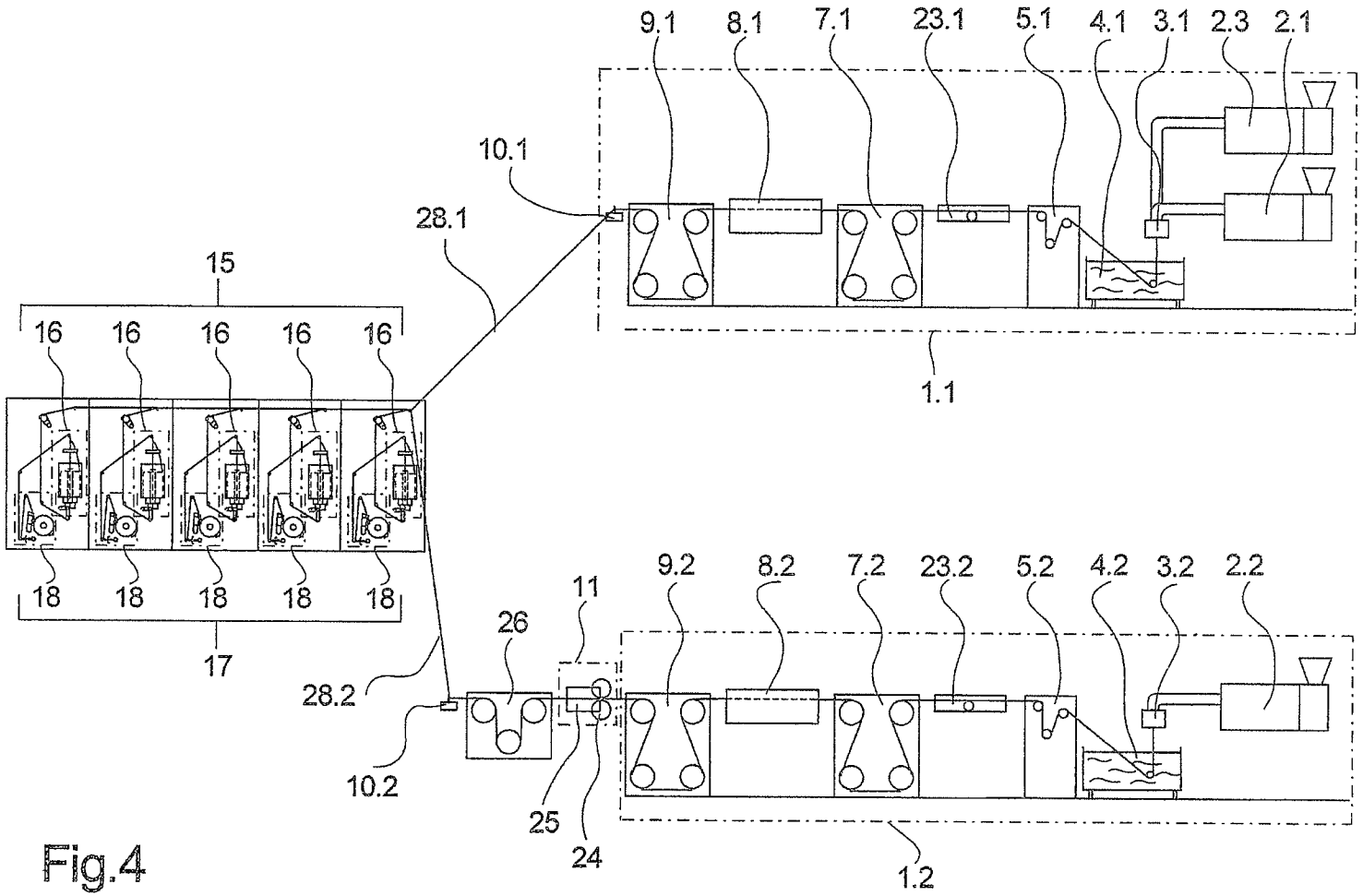
FIG. 4 shows a schematic view of a further embodiment of the apparatus according to the invention for carrying out the method according to the invention.

A further embodiment of the apparatus according to the invention for carrying out the method for the production of a turf yarn is schematically illustrated in FIG. 4. The embodiment is substantially identical to the embodiment according to FIG. 1, such that only the differences are explained below, and in other aspects, reference is made to the description provided above.

In the embodiment illustrated in FIG. 4, one flat film is extruded in each of the extrusion devices 1.1 and 1.2, and is cut into ribbons. As such, the extrusion devices 1.1 and 1.2 each have extrusion heads 3.1 and 3.2 through which a flat film is extruded.

In the extrusion device 1.1, two polymer materials are extruded in the extrusion head 3.1 by means of coextrusion to create the flat film. For this purpose, the extruders 2.1 and 2.3 are functionally assigned to the extrusion head 3.1. The extruders 2.1 and 2.3 could extrude a polymer material in different colors, for example, to extrude a two-colored flat film, for example. However, it is also possible to extrude two different polymer materials through the extruders 2.1 and 2.3.

For the purpose of cutting the flat films extruded in the extrusion devices 1.1 and 1.2 to make a ribbon grouping 28.1 and 28.2 for each film, a film cutting device 23.1 and 23.2 is arranged before the first godet assembly 7.1 and 7.2. One flat film fed to each of the film cutting devices 23.1 and 23.2 is cut into a plurality of individual ribbons.

The subsequent treatment of the ribbon grouping 28.1 and 28.2 in the extrusion devices 1.1 and 1.2 is identical to the embodiment named above, such that the ribbon grouping 28.1 is stretched between the godet assemblies 7.1 and 9.1, and the ribbon grouping 28.2 is stretched between the godet assemblies 7.2 and 9.2.

In order to produce a crimping on the ribbon grouping 28.2 of the extrusion device 1.2, the crimping device 11 in the embodiment illustrated in FIG. 4 is formed by crimping rolls 24 and a compression chamber 25. The latter is arranged directly behind the second godet assembly 9.2. In this way, all ribbons of the ribbon grouping 28.2 can be crimped together at the same time. For this purpose, the ribbon grouping 28.2 is guided through a roll gap between the crimping rolls 24, and conveyed into the compression chamber 25.

On the outlet side of the crimping device 11, the ribbon grouping 28.2 is drawn by a third godet assembly 26 with multiple driven godets, and is then fed to the following tie device 15 and spooling device 17 for the purpose of winding and spooling.

On the outlet side of the extrusion device 1.1, the ribbon grouping 28.1 is divided by means of the guide rail 10.1 into a plurality of fiber bundles, and on the outlet side of the extrusion device 1.2, the ribbon grouping 28.2 is divided by means of the guide rail 10.2 into a plurality of fiber bundles. The fiber bundles assigned to the ribbon grouping 28.1 are each formed from multiple flat ribbons. In contrast, the fiber bundles of the ribbon grouping 28.2 contain multiple crimped ribbons. Both fiber bundles are each fed to a separate winding station 16 to be brought together into the turf yarn. Following the winding of both fiber bundles with a tie thread, the turf yarn is wound in a downstream spooling station 18 to make a spool.

In the embodiment of the apparatus according to the invention illustrated in FIG. 4, the ribbon groupings 28.1 and 28.2 are produced with the godet assembly set in such a manner that the peripheral speed of the second godet assembly 9.1 of the extrusion device 1.1 is the same as the peripheral speed of the third godet assembly 26 on the outlet side of the extrusion device 1.2. In this way, the further treatment of both ribbon groupings 28.1 and 28.2 can be carried out at the same guiding speeds.

The construction of the extrusion device for producing the ribbon groupings 28.1 and 28.2 shown in FIG. 4 is exemplary in nature. In principle, additional treatment steps, such as heat setting or a further stretching step, can also be included. A fibrillation of the ribbon groupings 28.2 prior to crimping is particularly advantageous for the production of special effects in the turf yarn. As such, the extrusion device 1.2 could have a fibrillating device which is arranged upstream in the thread routing to the crimping device 11. In this case, a network-like structure is produced on each individual ribbon of the ribbon grouping. This structure persists through the crimping, and only opens in a tufting process during the production of a turf carpet. As such, the monofilaments take on characteristics of the turf yarn.

Likewise, the further treatment by winding and spooling the fiber bundle is exemplary in nature. By way of example, the possibility exists of producing the composite of the fiber bundles by means of texturing or by swirling. Likewise, spooling stations can be used wherein it is possible to continuously wind the spools.

The extrusion devices shown in the embodiments are implemented in pairs for the purpose of producing monofilaments or ribbons. These embodiments are likewise only exemplary in nature. In principle, a combination of the embodiments according to FIG. 1 and FIG. 4 is possible in such a manner that in one of the extrusion devices only monofilaments are produced, and in the second extrusion device, only ribbons are produced, such that the turf yarn is formed from a composite of monofilaments and ribbons.

In the embodiments shown, the number of the winding stations and spooling stations is exemplary in nature. As such, in the case of large-scale devices, it is common to arrange a number of such stations next to each other along a longitudinal side of the machines.

The invention claimed is:

1. An apparatus for production of a turf yarn for artificial turf, said apparatus comprising:

a first extrusion device for the purpose of producing multiple monofilaments or ribbons from a first polymer material;

a second extrusion device for the purpose of producing multiple monofilaments or ribbons from a second polymer material;

the two extrusion devices being arranged next to each other, wherein a crimping device for crimping the monofilaments or ribbons is arranged behind one of the extrusion devices; and a tie and winding device for bringing together multiple crimped and non-crimped monofilaments and/or ribbons into a turf yarn by winding a tie thread around them, the extrusion devices, the crimping device and the tie and winding device are arranged in a continuous process sequence.

2. The apparatus according to claim 1, wherein the extrusion devices each have at least one godet assembly, and wherein the godet assemblies of both extrusion devices can be driven and controlled independently of each other.

3. The apparatus according to claim 2, wherein the crimping device is designed as a compression chamber texturizer in which a fiber bundle or a fiber grouping can be crimped.

4. The apparatus according to claim 1, wherein the tie device has a winding station in which a tie thread is wound around the monofilaments and/or the ribbons which have been brought together.

5. The apparatus according to claim 4, wherein a spooling device is arranged behind the tie device, and the turf yarn can be wound into a spool by means of said spooling device.

6. The apparatus according to claim 1, wherein the extrusion devices each have one or two extruders for melting polymer materials.

7. The apparatus according to claim 1, wherein the tie device has a plurality of winding stations, and wherein a plurality of spooling stations of a spooling device are arranged behind the winding stations.

* * * * *